US005887370A

United States Patent [19]

Mizell

[11] Patent Number: 5,887,370

[45] Date of Patent: Mar. 30, 1999

[54] ACTIVITY SCHEDULE RECORDING DEVICE

[76] Inventor: Martie Fritz Mizell, 404 Oakwood Dr., Wichita, Kans. 67208

[21] Appl. No.: 919,188

[22] Filed: Aug. 19, 1997

[51] Int. Cl.[6] ..... G09F 11/04

[52] U.S. Cl. ..... 40/495

[58] Field of Search ..... 40/495, 496

[56] References Cited

U.S. PATENT DOCUMENTS

| | | | |
|---|---|---|---|
| 397,774 | 2/1889 | Briggs | 40/495 X |
| 478,363 | 7/1892 | Reed | 40/496 X |
| 1,779,684 | 10/1930 | Van Sicklen, Jr. | 40/495 |
| 1,951,022 | 3/1934 | Iverson | 40/455 |
| 2,787,069 | 4/1957 | Ferguson et al. | 40/495 |
| 3,297,249 | 1/1967 | Light | 40/495 X |
| 4,958,454 | 9/1990 | Chan et al. | 40/495 |

*Primary Examiner*—Joanne Silbermann
*Attorney, Agent, or Firm*—Robert O. Blinn

[57] ABSTRACT

Disclosed is an Activity Schedule Recording Device generally comprising a flat shell that carries and encloses rotatably mounted indicator discs having indicator numbers. The indicator numbers on the indicator discs can be seen in view openings in the shell. The view openings have labels that indicate a schedule item. As the corresponding disc is manually rotated, indicator numbers can be changed to correspond to the scheduled time for each item.

10 Claims, 3 Drawing Sheets

ACTIVITY SCHEDULE RECORDING DEVICE

CROSS REFERENCE TO RELATED APPLICATION

This application claims the benefit of U.S. Provisional Application No. 60/023,356 filed 20 Aug. 1996.

BACKGROUND OF THE INVENTION

1. Field of the Invention

The present invention relates to a device for recording a schedule of activities. More particularly, the present invention relates to a portable, hand held device for recording the scheduled times for a number of activities.

2. Description of the Prior Art

Numerous devices and methods have been employed by individuals to record a schedule of activities. Most notably, the Daytimer™ organizer, a notebook calendar based system has been provided to record appointments, activities and the like. Another calendar based system for recording an activity schedule is disclosed in U.S. Pat. No. 5,271,172 by Ureta. Ureta discloses a calendar system having a separate day sheet for each day where each of the day sheets has on one side a grid with numbered rows for recording activities. On the other side of each day sheet in Ureta, is a 24 hour clock surrounded by 48 enclosed spaces disposed at one half hour increments. Ureta discloses that reference numbers corresponding to activities recorded in the numbered rows on the opposite side of the day sheet can be written in each of these enclosed spaces around the 24 hour clock thereby recording a schedule of activities for a given day. A number of such devises are well known in the art. Maintaining reliable personal schedules has long been a concern of people confronted with numerous and varied activities.

Notwithstanding the presence in the prior art of a number of highly effective scheduling systems such as those referred to above there is a need for a simple, compact scheduling device that can be used by people participating in scheduled activities. More particularly, those participating in an organized group activity such a guided group travel tour need a means for recording the scheduled times for the various daily activities that occur during each day of a guided group travel tour.

Every year, thousands of travelers engage in guided group travel tours. Typically, these tours comprise a tour group led by a tour guide who guides the tour group through a number of locations over a period of days or even weeks. Usually, a tour group will spend one day at each location and see various points of interest. During the course of a guided travel tour, the tour guide must not only communicate his or her knowledge of the points of interest along the way but must also effectively communicate the schedule for each day. Such a schedule could include such items as when luggage will be picked up, when transportation will depart and when meals will be served.

A constant recurring problem that arises during the course of a guided tour is that members of a tour group will forget daily schedule items. When members of a tour group forget schedule items, they may miss the schedule items or they may ask the tour guide to repeat the schedule. In either case the tour is disrupted or delayed. Since travelers do not want to carry bulky appointment notebooks and writing instruments. They are usually not inclined to write down the daily schedule. Accordingly, there is a need for a simple, hand held device that can be used by a tour group traveler to record the items of a daily schedule without the use of a notebook and a writing instrument.

SUMMARY OF THE INVENTION

The present invention satisfies this need by providing a new, simple, hand held device that can be used to record the elements of a daily travel schedule without a writing instrument. The Activity Schedule Recording Device generally comprising an outer shell that carries and encloses rotatably mounted indicator discs having indicator numbers that correspond to hours to the day. The indicator numbers inscribed on the indicator discs can be seen in view openings in the outer shell. The view openings have labels that indicate a schedule item. As an indicator disc corresponding to a schedule item is manually rotated, indicator numbers can be changed to correspond to the scheduled time for each item. The Activity Schedule Recording Device is very simple, very compact and very easy to use.

The second preferred embodiment employs a second means for locking the indicator discs that includes indicator discs that are not rotatably mounted on fixed pins. The indicator discs of the second preferred embodiment can float in elongated recesses. This locking means features indicator discs that have teeth and an outer shell that has elongated recesses for slidably and rotatably receiving the indicator discs. This locking means also features a shell having recess openings that each have a width less than an indicator disc and that are each in communication with a corresponding recess. To complete this locking means, the shell also has fixed cogs near the recess openings for engaging the teeth of the indicator discs and springs opposite the recess openings for pushing the indicator discs outwardly toward the cogs so that the indicator disc teeth engage the cogs and are locked from rotating. When an indicator disc is pushed inwardly against one of the springs, the indicator disc teeth disengage the cogs and the indicator disc can be rotated to change the indicator numbers or indicia appearing in the view openings.

BRIEF DESCRIPTION OF THE DRAWINGS

The following detailed description refers to the attached drawings in which.

DETAILED DESCRIPTION OF THE PREFERRED EMBODIMENT

Figure 1:
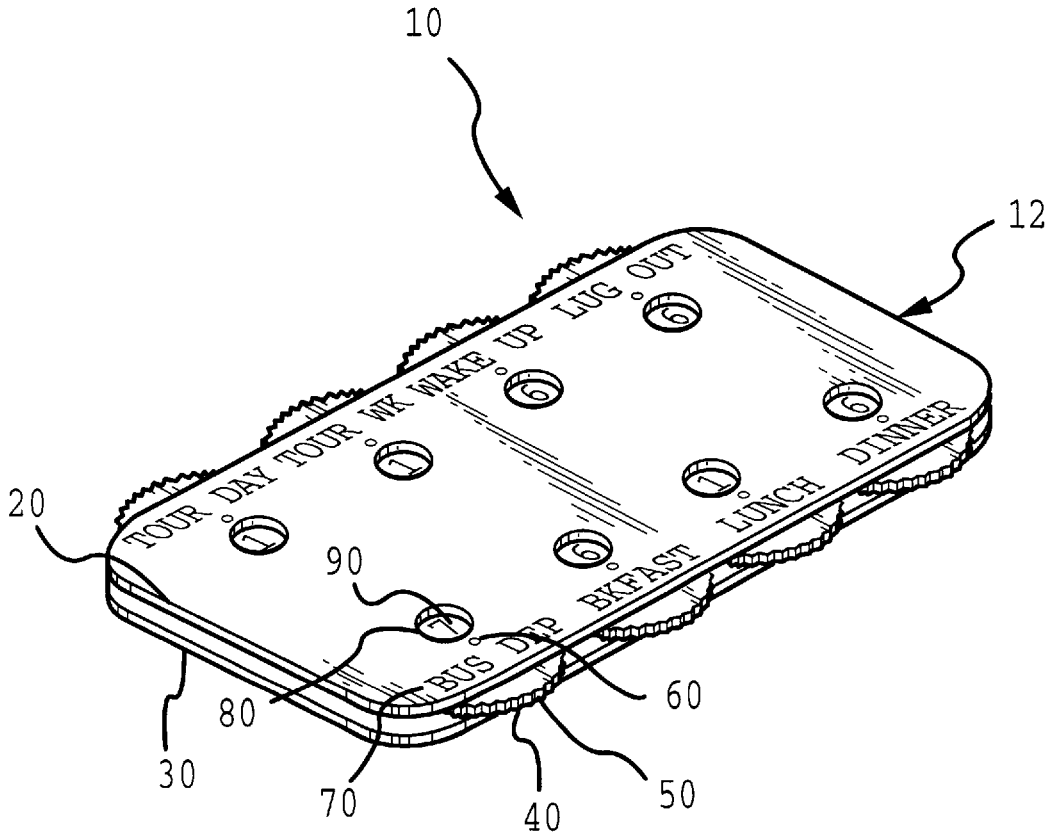
FIG. 1 is a perspective view of the Activity Schedule Recording Device.

FIG. 1 is a perspective view of the Activity Schedule Recording Device 10. The Activity Schedule Recording Device 10 has an outer shell 12 which in the preferred embodiment comprises a substantially flat top panel 20 and a substantially flat bottom panel 30. A plurality of adjustable indicator discs 40 are carried by outer shell 12. Each indicator disc 40 has radially inscribed indicator numbers 90 that correspond to hours of the day. Each indicator disc 40 is rotatably mounted between top shell panel 20 and bottom shell panel 30. Top panel 20 also has a means for indicating one of each indicator number 90 inscribed on each indicator disc 40. A means fo selecting one of the indicator numbers 90 is provided. In the preferred embodiment, each indicator number 90 on each of the indicator discs 40 can be selected by rotating it to align with a view opening 80 in top shell panel 20. As as each indicator disc 40 is rotated, a new indicator number 90 comes into view in each view opening 80. Each indicator disc 40 may be rotatably mounted on a pin 60 and each disc 40 has a serrated edge 50 so that it can be easily turned. Each view opening 80 is marked by a view opening label 70 which corresponds to a scheduled activity.

Figure 2:
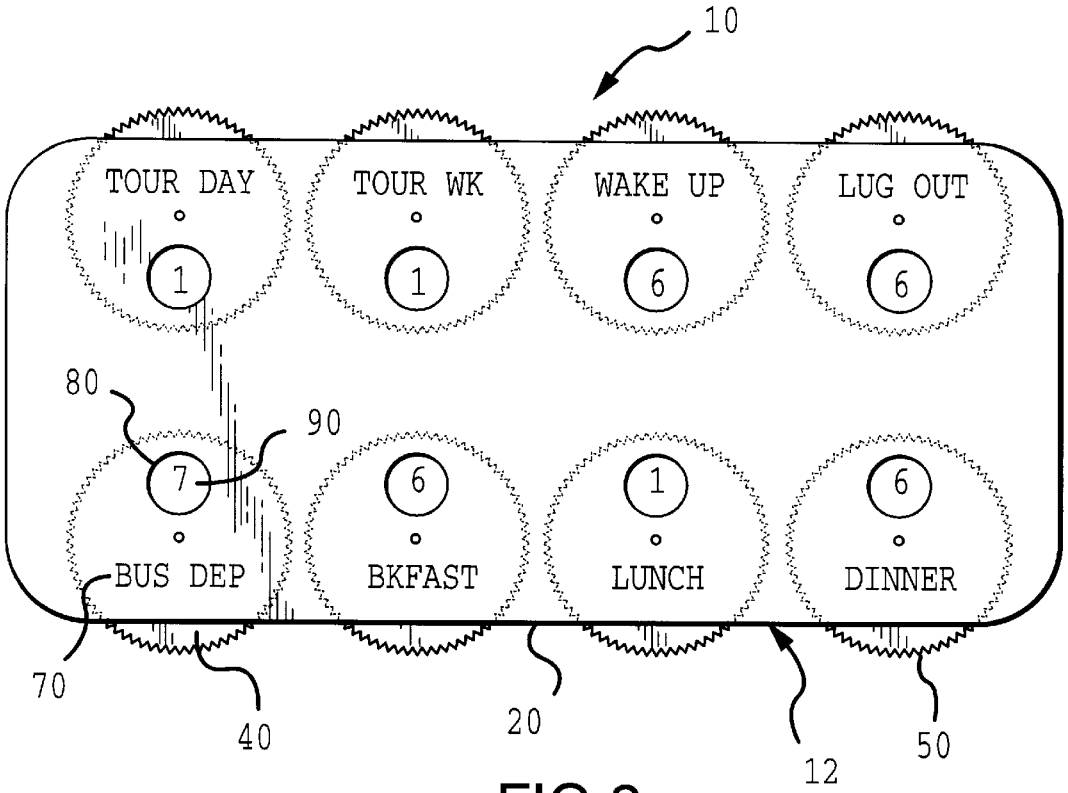
FIG. 2 is a top view of the Activity Schedule Recording Device.

FIG. 2 provides a top view of the Activity Schedule Recording Device 10. As can be seen in FIG. 2, each view opening 80 is marked by an opening label 70. In the preferred embodiment, view opening labels 70 are provided indicating wake up time "WAKE UP", the time to put luggage out for pick up "LUG OUT", breakfast "BK FAST", lunch "LUNCH", dinner "DINNER", bus departure time "BUS DEP", the day of the tour "TOUR DAY." as well as the tour week "TOUR WK". Each indicator number 90 can be clearly seen in each view opening 80. In the preferred embodiment, view openings 80 and view opening labels 70 are provided only in top shell panel 20. It should be noted that the device of the present invention can be embodied as a two sided device having two sets of indicator discs and a shell having view openings in both the top and bottom shell panels.

Figure 3:
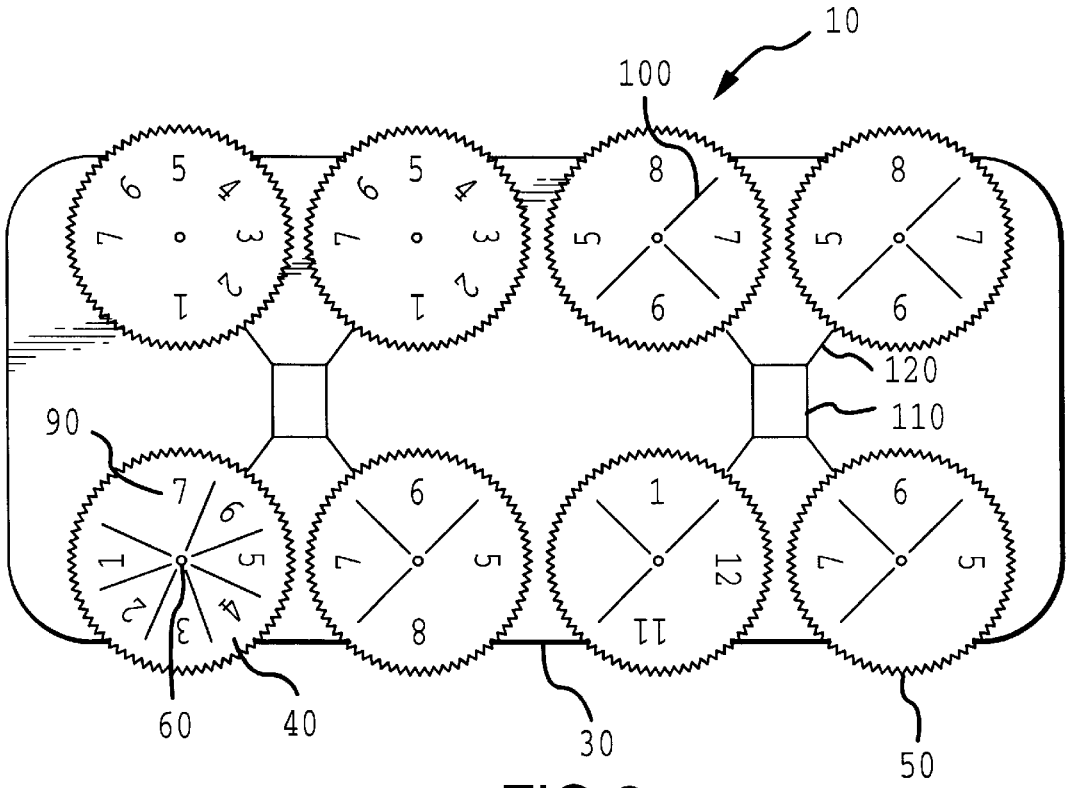
FIG. 3 is a top view of the Activity Schedule Recording Device with the top shell panel removed.

FIG. 3 provides a top view of the Activity Schedule Recording Device 10 with top shell panel 20 removed. Indicator numbers 90 are radially spaced on indicator discs 40 so that indicator numbers 90 can not be seen outside the edge of top shell panel 20. It should also be noted, that each indicator disc 40 has been marked so that indicator numbers 90 advance as each indicator disc 40 is rotated clockwise. As can be seen in FIG. 3, some of the indicator discs 40 have division markings 100 that are used to indicate half hour increments between indicator numbers 90. As can be readily understood by the skilled reader, no such marks are provided on those indicator discs used to indicate tour week and tour day. Blank indicators 105 are provided to indicate when an activity will not occur on a given day.

As can be seen in FIG. 3 Flexible prong 120 is attached to prong mount 110 and engages the serrated edge 50 (see FIG. 1) of disc 40. Prong 120 repeatedly deflects as serrated edge 50 of indicator disc 40 is pulled under prong 120 as indicator disc 40 is rotated. In this way, each prong 120 provides turning resistance so that each indicator disc 40 can only be turned by deliberate manual force. Each Prong 120 can be disposed to contact the serrated edge 50 of indicator disc 40 at an angle so that only clockwise rotation of each indicator disc 40 is possible.

Further, it should be noted by the skilled reader that other means could be employed to provide turning resistance to each indicator disc 40 or that means could be employed to lock each indicator disc 40 to prevent accidental rotation of each indicator disc 40. Small resilient grommets (not shown) can be placed between each indicator disc 40 and either or both top shell panel 20 and bottom shell panel 30 to provide friction against an accidental rotation of each indicator disc 40.

Figure 4:
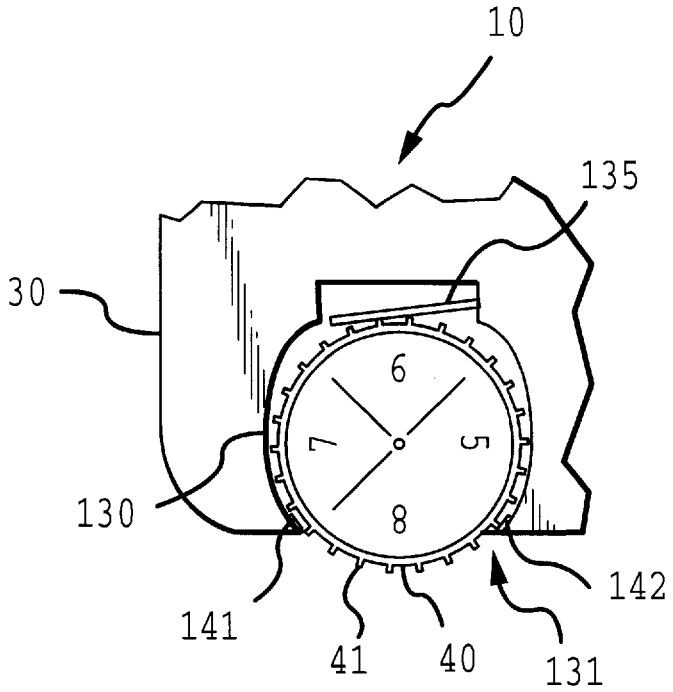
FIG. 4 is a detail view of an indicator disc.
Figure 4A:
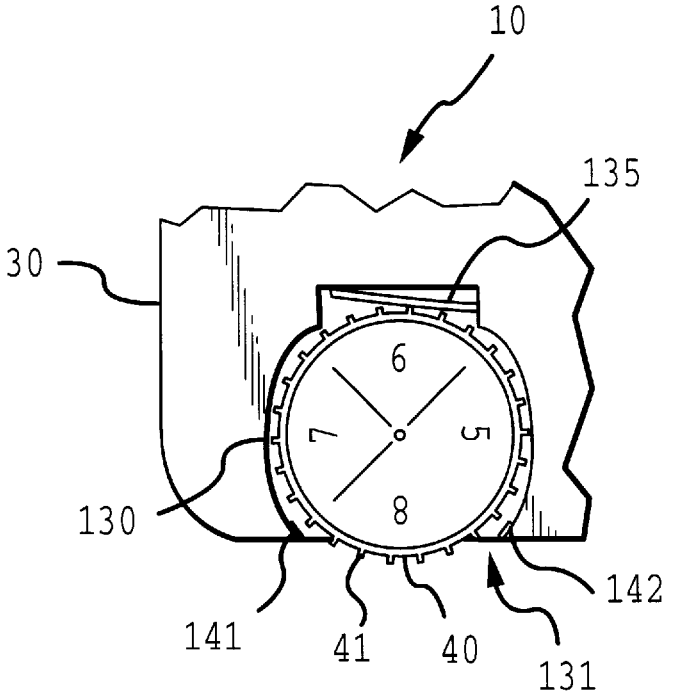
FIG. 4A is detail view of an indicator disc when urged away from a recess opening.

FIG. 4 and FIG. 4A illustrates a means for locking each indicator disc 40 into place. In FIG. 4, bottom panel 30 includes an oval shaped recess 130 having a recess opening 131. Indicator disc 40 is not rotatably mounted on a pin but floats within recess 130 and is urged out of the recess by spring member 135 positioned at the top of recess 130 opposite recess opening 131. As can be seen In FIG. 4, Indicator disc 40 also has teeth 41 protruding from its periphery. Corresponding cogs 141 and 142 disposed adjacent recess opening 131 engage teeth 41 and prevent indicator disc 40 from rotating while spring member urges Indicator disc 40 toward recess opening 131. As illustrated in FIG. 4*a*, when indicator disc 40 is manually forced in against spring member 135 it can be rotated within recess 130 as teeth 41 disengage from cogs 141 and 142. As manual inward pressure on indicator disc 40 is released, spring member 135 urges indicator disc 40 toward recess opening 131 as teeth 41 engage cogs 141 and 142 thereby preventing further rotation of indicator disc 40 relative to bottom panel 30.

Other adjustable indicators carried by an outer shell could be employed to record scheduled times for predetermined scheduled activities. For example, adjustable indicators comprising sliding pointers could be employed to record scheduled times along a plurality of linear scales. A plurality of activity labeled sliding pointers could be used with a single linear scale to record a plurality of scheduled activities.

As can be readily understood by those skilled in the art, the device of the present invention can be used in a number of applications. For example, more general indicator numbers could be employed on the indicator discs. A mask employing an easily removable adhesive could be used to provide a means to easily change view opening labels so that the device of the present invention could be used by those wishing to record general schedule items rather than predetermined schedule items.

The skilled reader, in view of this specification may envision numerous modifications and variations of the above disclosed preferred embodiment.

Accordingly, the reader should understand that these modifications and variations, and the equivalents thereof, are within the spirit and scope of this invention as defined in the following claims, wherin I claim:

1. A devise for recording information comprising, an outer shell and an indicator disc, the indicator disc having teeth and indicia, the outer shell further including a recess adapted for rotatably and slidably receiving the indicator disc, a recess opening in the periphery of the outer shell in communication with the recess having a width less than the diameter of the indicator disc, a spring for pushing the indicator disc toward the recess opening, at least one cog adapted for engaging the teeth of the indicator disc to lock the indicator disc when the indicator disc is pushed by the spring toward the recess opening, the cog further adapted to disengage from the teeth of the indicator disc to allow manual rotation of the indicator disc when it is pushed away from the recess opening and into the spring, the outer shell also having view openings for selectively viewing one of the indicia on the indicator disc, the indicator disc pushed against the spring and rotated until one of the indicia is displayed in the view opening, the indicator disc locking into a fixed position when the indicator disc is no longer pushed against the spring whereby one of the indicia is selectively displayed in the view opening to record information.

2. An activity schedule recording device comprising, an outer shell and at least one indicator disc, each of the indicator discs having top and bottom faces and an edge, a multiplicity of teeth disposed radially about each the indicator discs, at least one of the top and bottom faces of each of the indicator discs having indicia representing hours of the day, or days in a sequence in scribed radially thereon, the outer shell having a top panel and a bottom panel, the bottom panel having recesses for receiving each of the indicator discs, the bottom panel having recess openings in the edge thereof in communication with the recesses, the recess openings having a width less than the diameter of the indicator disc, the panel having springs for urging each of the indicator discs toward the recess openings, the recesses each having an elongated shape adapted to allow each of the indicator discs to move between a position close to the recess opening and a position away from the recess, the bottom panel having cogs for engaging the teeth projecting from the indicator discs when the indicator discs are urged by the springs into the positions close to the recess openings, the cogs and the teeth also adapted so that the cogs disengage the teeth of each of the indicator discs when each of the indicator discs are pushed into a position away from the recess opening, the recesses adapted to allow each of the indicator discs to rotate when each of the indicator discs is in a position away from the recess opening, at least one of the top and bottom panel having view openings for selectively displaying the indicia disposed on each of the indicator discs and labels for labeling the view openings to indicate a scheduled activity or schedule element, manual inward pressure being applied to one of the indicator discs as the indicator disc is urged in against the spring member and as the teeth of the indicator disc disengage the cogs to allow rotation of the indicator disc, the indicator disc being manually rotated until one of the indicia is selectively displayed by the view opening, the manual inward pressure released as the spring member urges the indicator disc toward the recess opening until the cogs engage the teeth of the indicator disc thereby locking the indicator disc to prevent its further rotation, whereby the indicator disc may be adjusted to selectively display one of the indicia to record a time of day or a day in a sequence of days to record a scheduled time for an activity or schedule element as indicated by the label.

3. The activity schedule recording device of claim 2 wherein the labels comprise a removable paper mask adapted to receive markings for labeling at least one of the view openings.

4. The activity schedule recording device of claim 2 wherein the labels for labeling the view openings to indicate a scheduled activity further comprise labels to indicate the day in a sequence of days of a guided tour, a week in a sequence of weeks in a guided tour, wake up time, a time for moving luggage out, a bus departure time, a breakfast time, a lunch time and a dinner time.

5. The activity schedule recording device of claim 2 wherein at least one of the indicator discs further comprise division markings disposed between the indicia representing hours of the day for marking fractions of an hour.

6. The activity scheduling device of claim 2 wherein at least one of the indicator discs further comprise a blank indicator for indicating that no activity is scheduled.

7. An activity schedule recording device comprising, an outer shell and at least one indicator disc, each of the indicator discs having top and bottom faces and an outer edge, a multiplicity of teeth projecting from the outer edge of each the indicator discs, at least one of the top and bottom faces having indicia corresponding to hours of the day, or days of the week, or a day in a sequence of days inscribed radially thereon, the outer shell having a top panel and a bottom panel, the bottom panel having recesses for receiving each of the indicator discs, the bottom panel having recess openings in its outer edge in communication with each of the recesses, the recess openings having widths less than the diameters of each of the indicator discs, each of the recesses also having an elongated shape adapted to allow each of the indicator discs to move between a position close to each of the recess openings and a position away from each of the recess openings, a pair of cogs disposed adjacent to each of the recess openings, the bottom panel having a pair of cogs disposed adjacent to each of the recess openings for engaging the teeth projecting from the indicator discs when the indicator discs are urged by the springs into the positions close to the recess openings, each of the pairs of cogs and the teeth of each of the indicator discs also adapted so that the cogs disengage the teeth of the indicator discs when each of the indicator discs is pushed into a position away from the recess opening, the recesses adapted to allow each of the indicator discs to rotate when each of the indicator discs is in a position away from the recess opening, the bottom panel also having spring members for urging each of the indicator discs toward each of the recess openings, the top panel also having view openings for selectively displaying the indicia on each of the indicator discs, the top panel further comprising view opening labels disposed adjacent to each of the view openings to indicate scheduled activities, manual inward pressure being applied to one of the indicator discs as the indicator disc is urged against the spring member and as the indicator disc teeth disengage from the cogs to allow rotation of the indicator disc, the indicator disc manually rotated until one of the indicia is positioned to be viewed in the view opening, the manual inward pressure released as the spring member urges the indicator disc toward the recess opening until the cogs engage the teeth of the indicator disc thereby locking the indicator disc to prevent its further rotation, whereby each of the indicator discs may be manually adjusted to display one of the indicia corresponding to an hour of the day or a day of the week or a day in a sequence of days in each of the view openings to record a time of day or a day for each of the scheduled activities indicated by each of the view opening labels.

8. The activity schedule recording device of claim 7 wherein at least one of the indicator discs further comprise division markings disposed between the indicia representing hours of the day for marking fractions of an hour.

9. The activity scheduling device of claim 7 wherein at least one of the indicator discs further comprise a blank indicator for indicating that no activity is scheduled.

10. The activity scheduling device of claim 7 wherein the plurality of labels corresponding to predetermined activities further comprise labels to indicate tour day, tour week, wake up time, luggage out, bus departure, breakfast, lunch and dinner.

* * * * *